US005170939A

United States Patent [19]

Martin

[11] Patent Number: 5,170,939

[45] Date of Patent: Dec. 15, 1992

[54] MULTIPLE COMPONENT SPRAY GUN

[76] Inventor: Olin H. Martin, P.O. Box 1423, Mesa, Ariz. 85201

[21] Appl. No.: 845,597

[22] Filed: Mar. 4, 1992

Related U.S. Application Data

[63] Continuation-in-part of Ser. No. 588,731, Sep. 27, 1990, abandoned.

[51] Int. Cl.[5] ..... B05B 15/02; B05B 7/04

[52] U.S. Cl. ..... 239/112; 239/412; 239/414; 239/416.1; 239/427; 239/432

[58] Field of Search ..... 239/112, 399, 412, 414, 239/415, 416.1, 427, 432, 467

[56] References Cited

U.S. PATENT DOCUMENTS

| | | | |
|---|---|---|---|
| 3,245,661 | 4/1966 | Breer et al. | 239/399 X |
| 3,690,556 | 9/1972 | McCain | 239/112 |
| 3,690,557 | 9/1972 | Higgins | 239/416.1 X |
| 3,708,123 | 1/1973 | Krueger | 239/415 |
| 3,786,990 | 1/1974 | Hagfors | 239/112 |
| 3,795,364 | 3/1974 | Kattner | 239/416.1 X |
| 3,837,575 | 9/1974 | Lehnert | 239/112 |
| 3,873,023 | 3/1975 | Moss et al. | 239/112 X |

*Primary Examiner*—Andres Kashnikow

*Assistant Examiner*—William Grant

[57] ABSTRACT

A multiple component spray gun for spraying plural components is useful in applications involving polyurethane foams, elastomeric coatings, paints, thermosetting resin formulations, and the like. The ejected components are atomized under high or low pressure via a novel multiple mixing action. The gun design allows for an exchange of the mixing chamber components without the need to dismantle the gun body. The concept of the spray gun involves a gun body and a nozzle, a rotatable ball passage valve including a ball with internal porting in a general Y-configuration with two opposing inlet passages and a cylindrical outlet bore with the ball positioned in a totally enclosed resilient resinous packing material. The preferred packing material is formed from polytetrafluoroethylene commonly referred to under the trademark Teflon. The A and B components are communicated across the passages of the Y-configuration prior to the novel multiple mixing action and material back flow is virtually eliminated. An air purge flow through the ball valve is rotated by means of a double acting pneumatic cylinder and both the air cylinder and ball reciprocate and rotate through an appropriate linkage.

7 Claims, 8 Drawing Sheets

MULTIPLE COMPONENT SPRAY GUN

CROSS REFERENCE TO PARENT APPLICATION

This application is a continuation-in-part of application Ser. No. 07/588,731 filed Sep. 27, 1990 and naming as the inventor Olin H. Martin; now abandoned.

TECHNICAL FIELD

The present invention generally relates to an improved spray gun for spray applying multiple components under pressure onto desired surfaces. More particularly, the invention relates to the spraying of combined plastic compositions subsequent to the mixing of at least two, preferably, but not essentially, chemically reactive, components in a mixing chamber. The spray gun is air purged to eliminate hardening or solidification of any residual mixed components in the device upon completion of spraying. End products of the spray applied compositions may include polyurethane foams, elastomeric coatings, paints, highly exothermic mixtures, thermosetting resin formulations, and the like. The preferred mode in utilizing the spray gun of this invention is via the spraying of polyurethane foams onto desired substrates.

BACKGROUND ART

The prior art describes a number of spray guns of the various types for spraying plural component materials in which the components are mixed prior to discharge or subsequent to discharge. For example, U.S. Pat. No. 3,837,757 shows an air actuator controlled by the trigger which operates the flow control ball valves. U.S. Pat. Nos. 3,806,030 and 3,752,398 disclose an apparatus for spraying plastics in which cleaning fluid is injected into the head by manually controlled valves after the spraying cycle. Air purge of the spraying apparatus is shown in U.S. Pat. No. 3,146,950. Another patent, namely U.S. Pat. No. 3,920,188 discloses a mode to disperse the polyurethane without the use of compressed air for atomizing or purging. U.S. Pat. No. 3,708,123 teaches about an airless spray apparatus permitting solvent and material flow into the spray apparatus involving a low pressure type operation using a novel mixing valve mechanism, which differs from the present invention. A rotary plug valve which is solenoid operated is shown in U.S. Pat. No. 2,659,628.

The description of a compressed air gun for spraying plural component coating materials is outlined in U.S. Pat. No. 3,837,023. This approach depends upon compressed air to atomize the mixed component materials ejected from the gun in a single mixing action, and to shape the spray pattern projected from the gun. During the spraying process the ejection orifice can not move axially or laterally from its cooperative association with the jets of air or the desired spray pattern will not be formed resulting in large droplets and/or uneven particle distribution. The orifice has to be stationary at all times, and the mixing depends upon the compressed air supply, which it cannot exceed. Additionally, U.S. Pat. No. 2,989,242, U.S. Pat. No. 3,245,661, U.S. Pat. No. 3,429,508, U.S. Pat. No. 3,795,364, U.S. Pat. No. 3,837,575 and U.S. Pat. No. 4,471,887 are all describing different functioning spray devices of different design.

DISCLOSURE OF INVENTION

The present invention provides a multiple component spray gun of improved design for spraying plural components generally described above. The concept of the spray gun involves a gun body and a nozzle, a rotatable ball passage valve including a ball with internal porting in a general Y-configuration with two opposing lateral inlet passages, which define an integral arrangement of the passages aligned at a 45 degree angle to connect with the valve chamber and a cylindrical outlet bore extending perpendicular to the two opposing passages with the ball positioned in a totally enclosed resilient resinous packing material within a metal housing of the gun body. The preferred packing material is formed from polytetrafluoroethylene commonly referred to under the trademark Teflon. The ball inlet passages are communicating with four inlet passages from the exterior of the metal housing by rotating the ball selectively in 90 degree increments to either receive material flow or an air purge through the two inlet passages of the ball into the valve chamber then exiting through the nozzle. The encapsulating Teflon packing has four bores and four steel rings to prevent cold flow at the apertures of said bores interposing the Teflon packing and the metal housing. Adjustable means are provided for applying a compressive load to the Teflon packing to cause it to sealingly engage the inner walls of the chamber and the exterior of the ball member. The adjustable means include a rigid circular gland member closely received in the bore and positioned to extend transversely thereof. The gland member is mounted in direct engagement with the packing and a circular opening in the gland member surrounds the opening stem. Disk spring means are positioned on the gland member on the side opposite the packing. Closely received in the bore outwardly of the disk spring means is a packing nut having an inner surface engaging the disk spring means. The packing nut means can be tightened to move toward the rigid gland member, thus compressing the disk spring means and apply a compressive load to the packing. An optional second rigid gland member can be employed to supply additional compression.

The flow control ball is rotated by means of a double acting pneumatic cylinder. The cylinder or air motor is connected to the ball and both reciprocate and rotate. A portion of the cylinder is provided with a helical slot with a movable air shaft blade. Therefore, as the air shaft blade reciprocates in the chamber under the influence of air pressure directed to one side and the other side of the blade, the blade will rotate causing the ball to rotate through an appropriate linkage. The exact details of the linkage connection and the degree of movement for the air shaft blade may vary dependent upon the type construction of the rotatable ball. The air is directed through port holes in the air motor to one side or the other side of the air shaft blade by means of a trigger and microswitch arrangement on the gun.

Most, but not all, multiple component guns mix liquid components only once and material back flow is a common problem The present invention differs from prior art and method in that it distributes material through the passages of the Y-configuration prior to the novel multiple mixing action and material back flow is virtually eliminated. Additionally, the gun design makes it possible to exchange mixing chamber components without the need to dismantle the gun body. Furthermore, the concept of a double acting pneumatic cylinder in connection with the design of a spray gun apparatus has not been formerly employed.

DESCRIPTION OF THE DRAWINGS

It is understood that both the foregoing general description and the following detailed description are exemplary and explanatory and are not restrictive of the invention. In the drawings:

Referring now to FIGS. 1 and 2 of the drawings in greater detail, spray gun 10 comprises a spray head 11 and a nozzle 40, with said spray head 11 consisting of a metal housing 37 with means 11*a* connected to a double acting pneumatic cylinder or air motor 12, a handle or pistol grip 13 extending at an angle from cylinder 12 and a trigger 14. The spray head 11, the handle 13 and the trigger 14, as well as other suitable parts of spray gun 10, are fabricated from materials which are chemically inert with respect to the components being mixed and may include aluminum and aluminum alloys, steel and copper alloys or any suitable wear resistant plastic materials.

Figure 2:
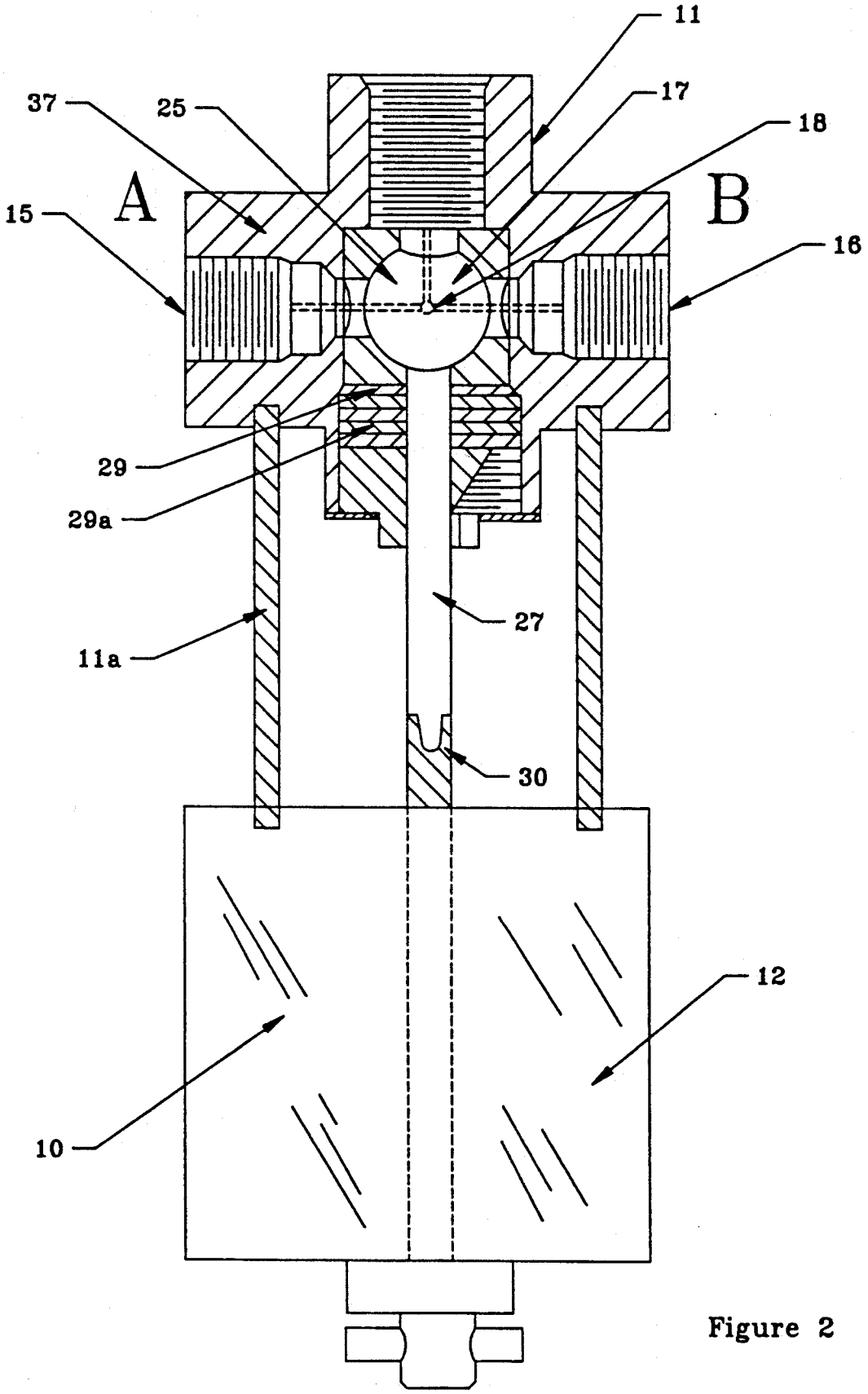
FIG. 2 is a top plan view and partially diagrammatic view of the gun seen in FIG. 1.
Figure 3:
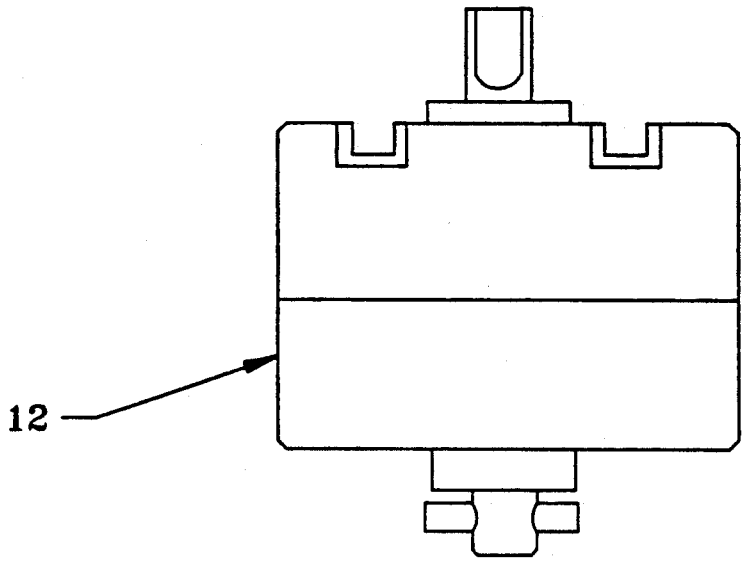
FIG. 3 is a side elevational view of the double acting pneumatic cylinder.

Conduits 15 and 16 each supply a different liquid to spray head 11, namely A and B components across a rotatable ball passage valve 17. The two components are combined at the juncture of an internal porting arrangement in the general Y-configuration then ejected into the spiral mixing chamber 19 inside gun nozzle 40 with the subsequent discharge of the material through orifice 20 by means of bore 40*a*. The rotatable ball passage valve 17 is returned to a non-spraying position automatically by releasing the trigger 14 of the spray gun 10 and reversing the mechanism to an air purge position via inlets 21 and/or 22 by means of the double acting pneumatic cylinder 12 as shown in FIGS. 2 and 3. Compressed air is introduced through hose 23 into the spiral mixing chamber 19 through air inlets 21 and/or 22 for the purpose of cleaning the front end of spray gun 10. In this way, the accumulation of deposits of sprayed material about the outlet of the spray gun is avoided. The pneumatic air cylinder 12, the ball passage valve 17 and the appropriate linkage all reciprocate and rotate by actuating the mechanism with compressed air supplied by hose 24.

Figure 4:
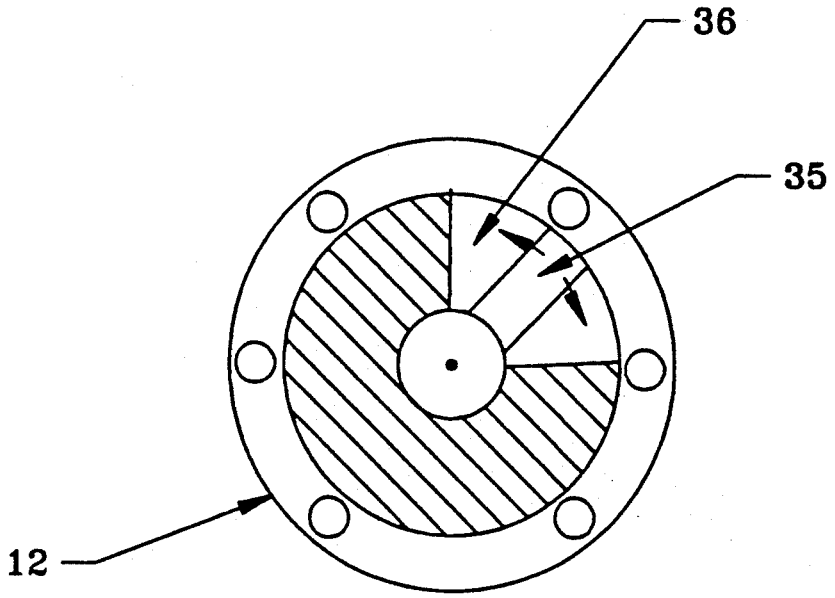
FIG. 4 is a cross sectional view of the cylinder seen in FIG. 3.

The rotatable ball passage valve 17 is positioned within a spherical cavity inside an encapsulating Teflon packing 25, which is secured by four steel rings 26 to prevent distortion (cold flow). The connecting stem 27 is embedded in a packing nut member 28, with a rigid circular gland member 29 closely received in the bore of the metal housing 37, in direct engagement with the Teflon packing 25, and rotatable ball passage valve 17 with disk spring means 29*a* positioned on the ball stem between gland member 29 and packing nut member 28, having an inner surface 44, engaging said disk spring means 29*a*. The stem 27 connects with a hollow tubular sleeve 30 extending forwardly from air motor 12. The actuating trigger of proper length is pivotally secured to gun body 10 by bolt 31. The fingers of a person manipulating the spray gun may easily grip the trigger 14 to pivot it toward the pistol grip or handle 13, which depresses valve plunger 32 and activates air valve 33 with the air being directed to one side or the other side through air inlet ports 34 into air motor 12 causing the air shaft blade 35 in the helical slot 36 to reciprocate and rotate in 90 degree increments as shown in FIG. 4. The withdrawal of the air from air motor 12 is accomplished by the release of trigger 14.

Figure 5:
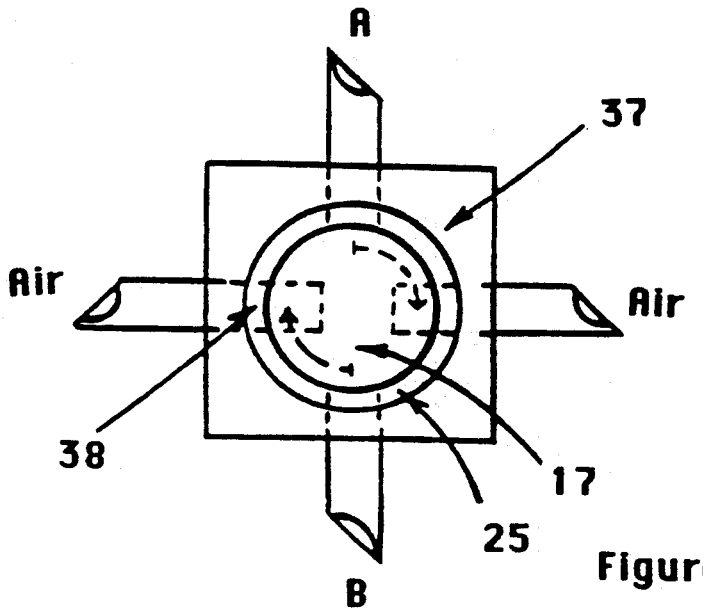
FIG. 5 is a top plan view and diagrammatic view of the rotatable ball for a two component application with an air purge.
Figure 6:
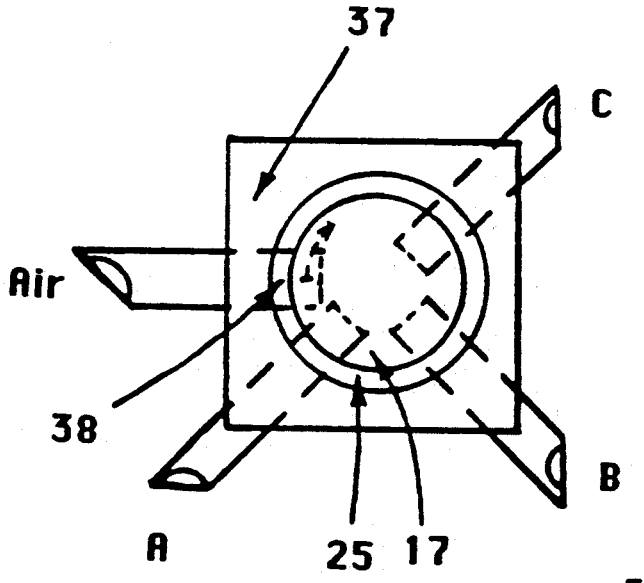
FIG. 6 is a top plan view and a diagrammatic view of the rotatable ball for a three component application with an air purge.

In the drawings in FIGS. 5 and 6 two configurations of mechanism are shown with the rotatable ball passage valve 17 separated from the metal housing 37 by the encapsulating Teflon packing 25 with bores 38 in the packing to allow for an alignment with the rotatable ball valve's inlet passages. FIG. 5 is in the air purge mode with the air exiting via the Y-configuration 18 (not shown)—the A and B components are prevented from entering through the two opposing inlet passages. A 90 degree rotation of the ball passage valve 17 will reverse the process by blocking off air flow and injecting the pressurized A and B components through the internal passages across the Y-configuration 18. FIG. 6 shows the injection of an A, B and C component under pressure entering through the inlet passages of the rotatable ball valve 17, with the air in the "off" position. A 45 degree rotation of the ball passage valve 17 will reverse the process according to the aforementioned mode of operation.

However, the present invention is not restricted to a two component or a three component spray mechanism with an air purge, but may involve additional multiple liquid components using different rotatable ball valve configurations with different internal passageway configurations all properly mixed and spray applied to the desired substrates. The components may be distributed by means of a low pressure or a high pressure type application.

Figure 1:
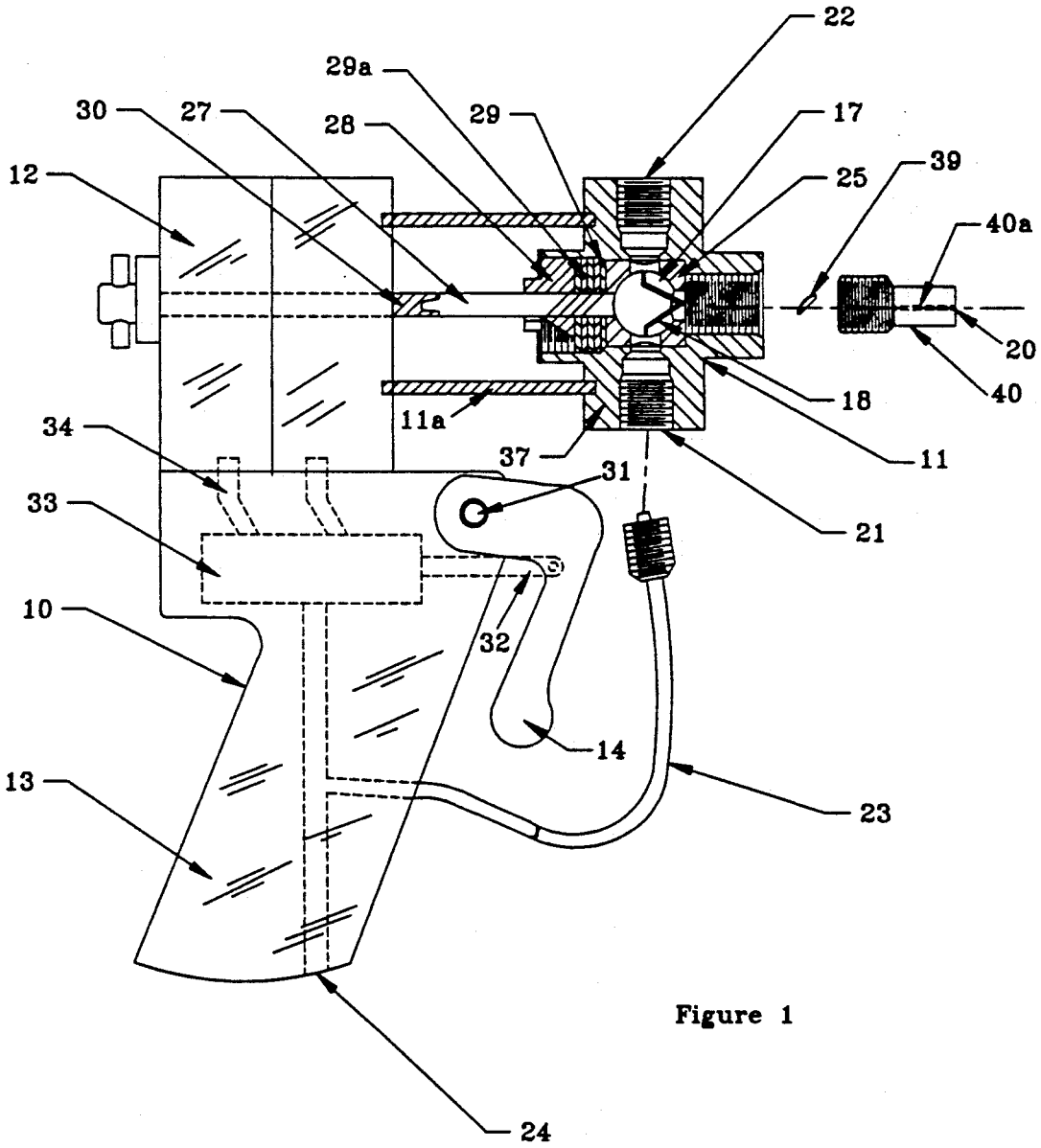
FIG. 1 is a side elevational view of the multiple component spray gun according to the invention.
Figure 7:
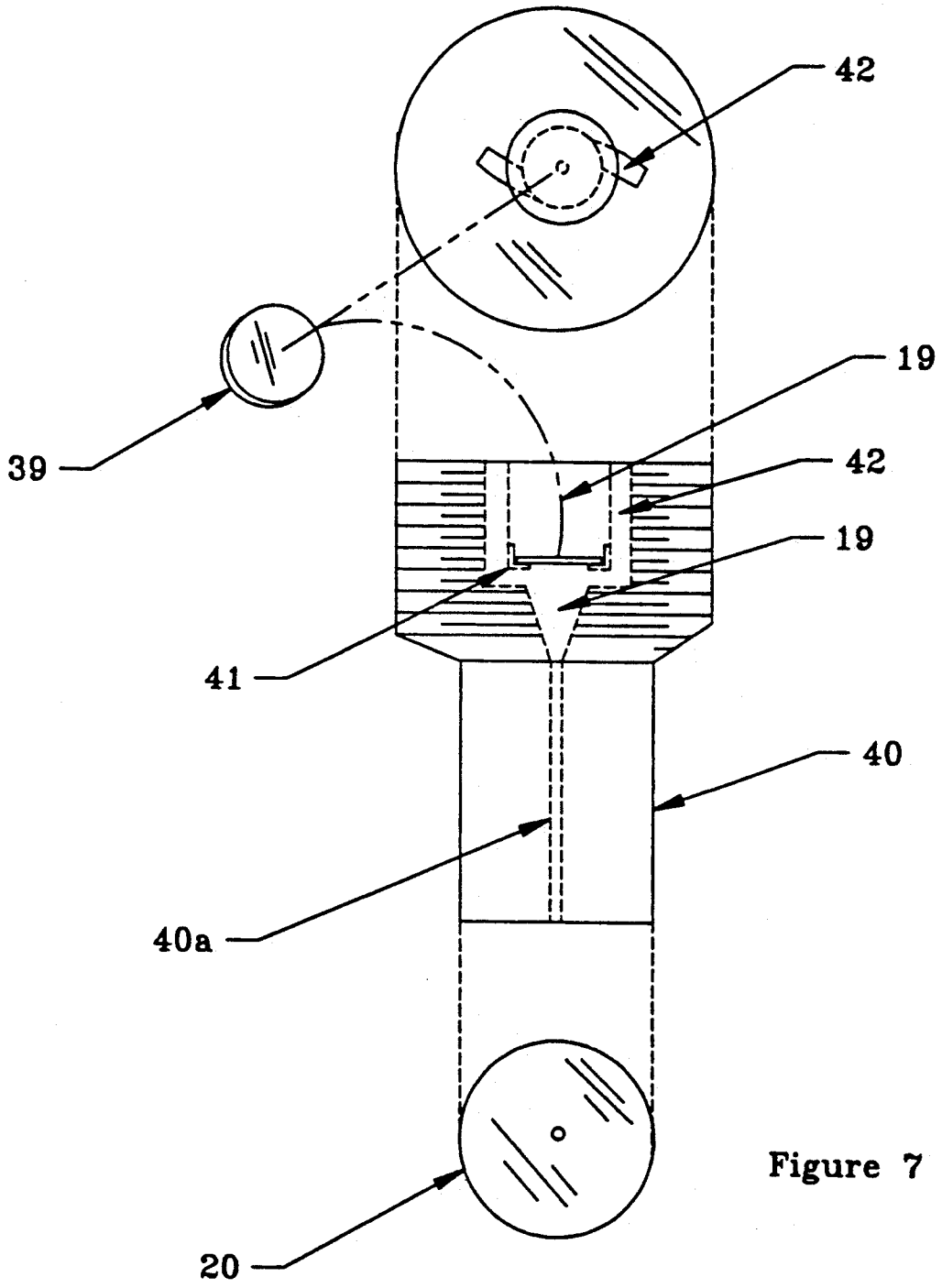
FIG. 7 is a top plan view of the premixing plate and ejection orifice.

Referring to FIG. 7 an improved gun nozzle design 40, over prior art, is shown involving a multiple mixing action. The A and the B components are forced under pressure into the inlet passages of the Y-configuration 18 (not shown), and the initial mixing occurs at the juncture of the passages. The combined material is forced onto the premixing plate 39 within gun nozzle 40, which is attached to offset grooves 41 within mixing chamber 19, and further mixing is taking place, followed by the material injection through the perpendicular grooves 42 within said mixing chamber 19, with the final material mixing occurring through the means of a spiral flow pattern within the conical cavity of the chamber 19, and the subsequent material discharge at the ejection orifice 20 via central bore 40*a*. Referring to FIGS. 1 and 2 of the drawings, the aforementioned mechanism involving a multiple mixing action via the rotatable ball passage valve 17, is shown from different angles.

Figure 8:
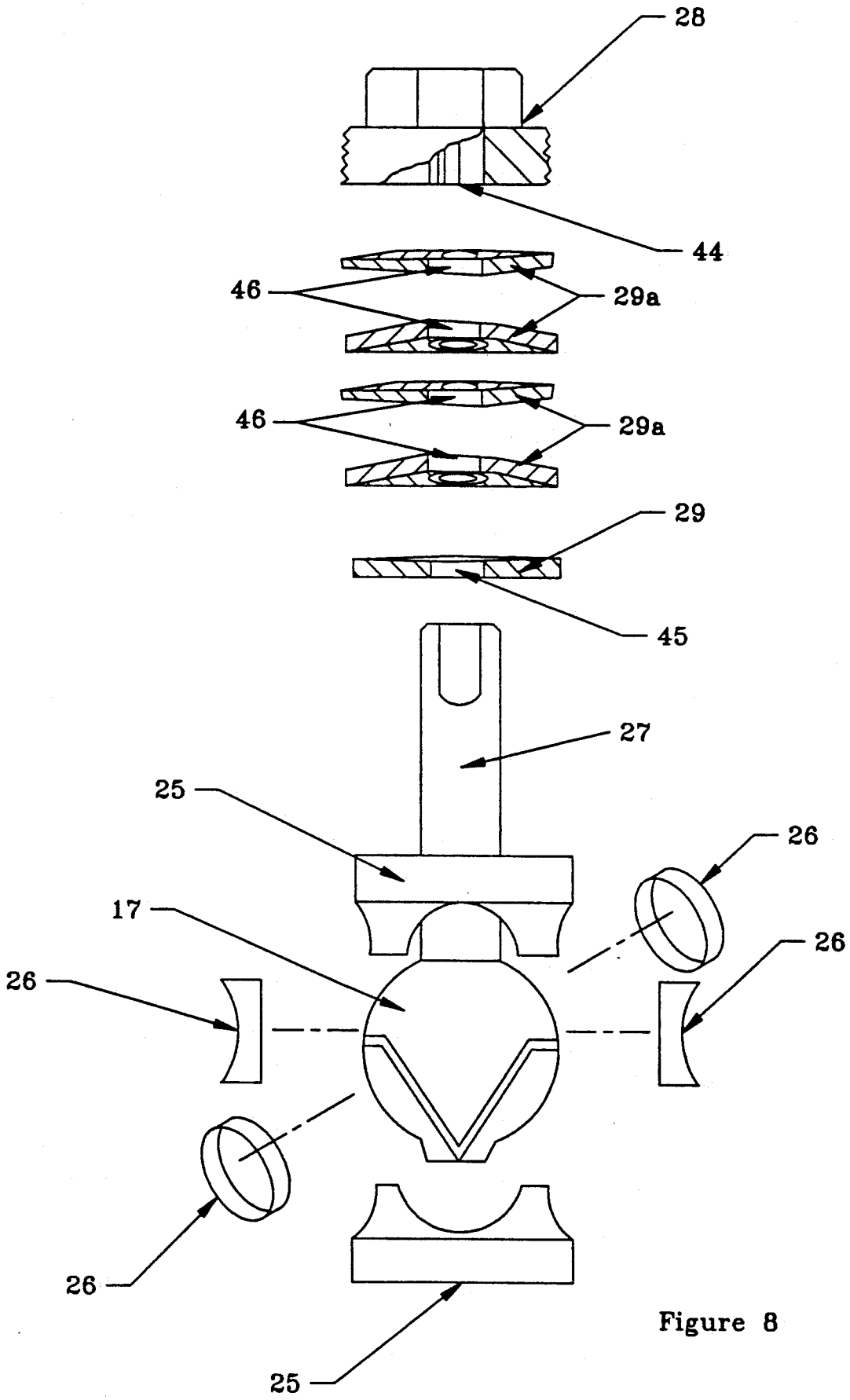
FIG. 8 is an exploded view showing certain components of the ball valve assembly.
Figure 9:
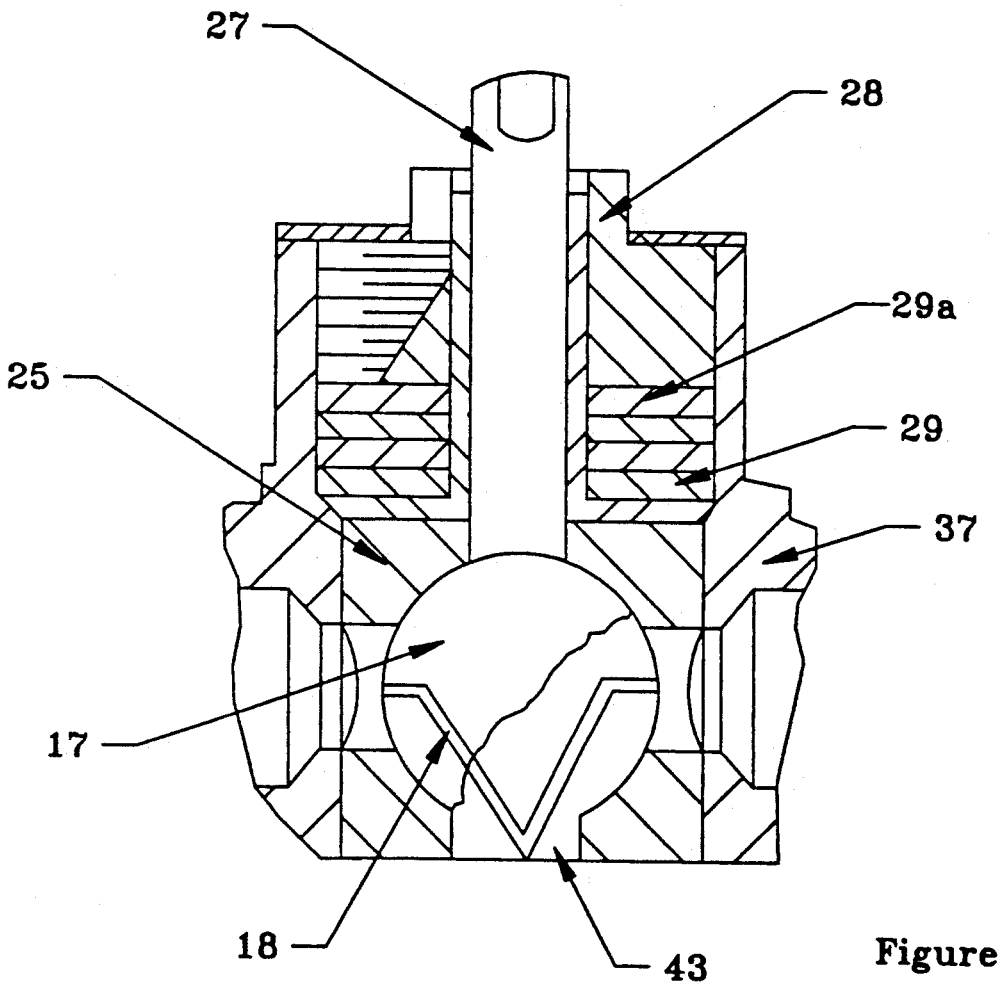
FIG. 9 is an enlarged partial cross-sectional view similar to FIG. 1.
Figure 10:
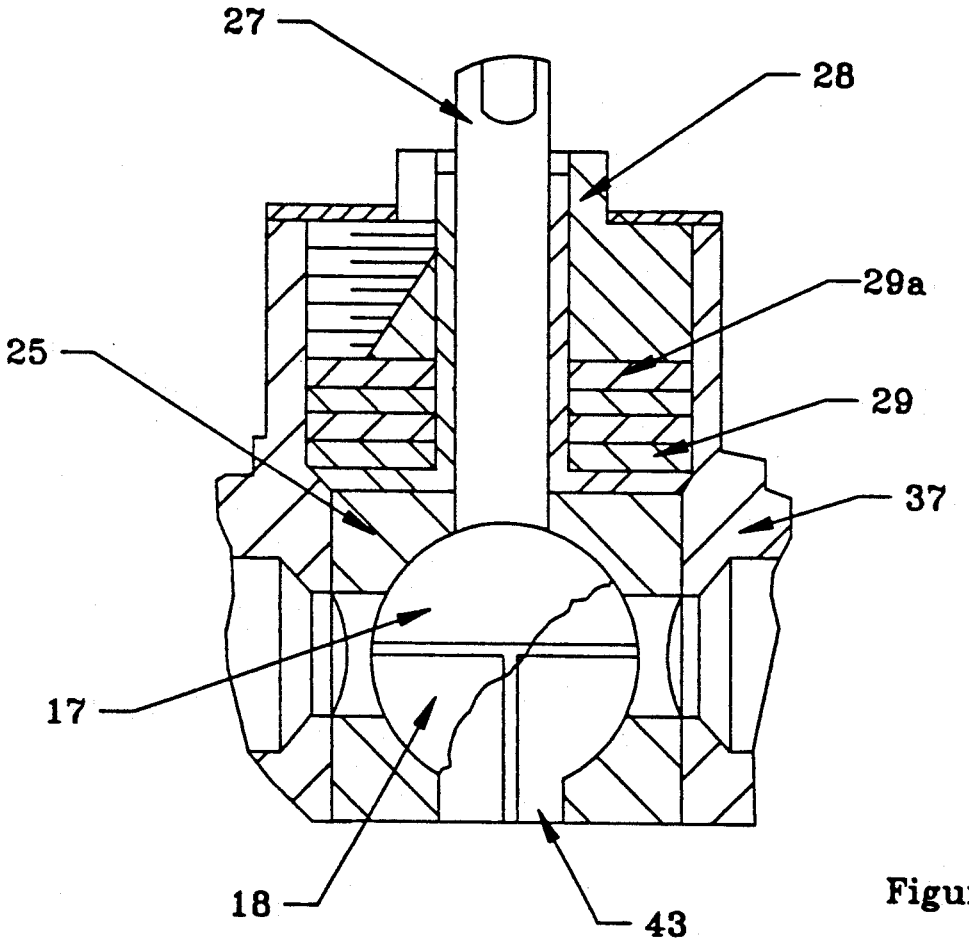
FIG. 10 is a view similar to FIG. 9 but showing a different alignment of the internal passages.

In the drawings in FIGS. 8 and 9 the rotatable ball valve assembly 17, is shown with the general Y-configuration passageways 18, merging in the trunion 43. Four steel rings 26, are closely received at the apertures of bores within the Teflon packing 25. The rotatable ball passage valve 17, has a cylindrical operating stem 27 extending axial outwardly the metal housing 37, to a position exterior of said metal housing 37 and terminating within bore 44 of packing nut member 28, with means of said packing unit nut member 28 and bore 44 to move toward the rigid gland member 29 through the disk spring means 29*a*, and to apply a compressive force to the Teflon packing 25. It should be noted that the rigid gland member 29, and the disk spring means 29*a*, have internal openings 45 and 46, which are only slightly larger than the cylindrical stem 27. The number and stacking arrangement of the metallic disk spring means 29*a* can be varied and they are positioned in an alternating facing relationship as shown in FIG. 8. The drawing in FIG. 10 discloses an alternate passageway arrangement in the general T-configuration 47.

In view of this disclosure many modifications of this invention will be apparent to those skilled in the art. Its is intended that all such modifications which fall within the true scope of this invention be included within the term of the appended claims.

What is claimed is:

1. A gun for spraying multiple components under pressure comprising a gun body and a nozzle; a rotatable ball passage valve including a ball with internal porting within a spherical cavity positioned inside an encapsulating polytetrafluoroethylene packing within a metal housing of said gun body; with said rotatable ball passage valve being positioned within a cylindrical bore extending inwardly from the exterior of said housing and defining a valve chamber, said ball being connected with four inlet passages extending from the exterior of said housing to said chamber; means including a cylindrical stem engaged with said ball and extending out of said housing for rotating said ball selectively in increments for communicating with said four inlet passages in said housing to receive either material flow or an air purge through two inlet passages of the ball and exiting through the nozzle; means to rotate said cylindrical stem with said ball through linkage with a double acting pneumatic cylinder; adjustable means for applying a compressive load to said encapsulating polytetrafluoroethylene packing in said spherical cavity transmitting it through said packing; ports formed through said encapsulating polytetrafluoroethylene packing at locations aligned with said four inlet passages and with one outlet passage extending through said metal housing; said adjustable means including four steel rings closely received at the apertures of said four inlet passages interposing said metal housing and said encapsulating polytetrafluoroethylene packing; with packing means about said cylindrical stem including a rigid gland member closely and slidably received in said housing; said rigid gland member having an opening through which said stem rotatably extends; a plurality of stacked disk springs surrounding and guided by said stem with an axially aligned packing nut member positioned to apply both unstressed and compressed conditions; with said nozzle having a generally conical inner spiral mixing chamber with perpendicular grooves extending from the inlet aperture of said mixing chamber inwardly therefrom and terminating into a central bore in axial alignment with an ejection orifice; a stationary premixing plate with a diameter less than the aperture of said spiral mixing chamber and coaxially attached to offset grooves within said mixing chamber; with the improvements for spraying the multiple components therefrom resulting in a pressurized mixing action through the means of said ball valve, said premixing plate, and said spiral mixing chamber within the gun nozzle.

2. The gun for spraying multiple components recited in claim 1, wherein said nozzle is in axial alignment with said ball passage valve and threadedly received in an aperture of said metal housing.

3. The gun for spraying multiple components recited in claim 1, wherein said axial aligned packing nut member positioned on said cylindrical stem to apply both unstressed and compressed conditions is threadedly received in an aperture of said metal housing.

4. The gun for spraying multiple components recited in claim 1, wherein said packing means includes a second rigid gland member closely and slidably received in said housing; said second rigid gland member having an opening through which said stem rotatably extends.

5. The gun for spraying multiple components recited in claim 1, wherein said rotatable ball passage valve is provided with at least two opposing lateral inlet passages which define an integral arrangement of the passages aligned at a 45 degree angle to connect with said valve chamber and said outlet passage, said opposing inlet passages extending perpendicular to said ejection orifice.

6. The gun for spraying multiple components recited in claim 1, wherein said rotatable ball passage valve is provided with a configuration of more than two inlet passages which define an integral arrangements of passages.

7. The gun for spraying multiple components recited in claim 1, wherein said rotatable ball passage valve is provided with a configuration of an internal arrangement of the two inlet passages aligned at a 90 degree angel with the outlet passage.

* * * * *